US006164497A

United States Patent [19]

Chia et al.

[11] Patent Number: 6,164,497

[45] Date of Patent: Dec. 26, 2000

[54] PAINT COLORANT DISPENSER WITH NOTCHED GAUGE ROD

[75] Inventors: Julian Chia, Richmond; Colm Murphy, Surrey, both of Canada

[73] Assignee: H.E.R.O. Industries, a division of Middlefield Bancorp Limited, Burnaby, Canada

[21] Appl. No.: 09/360,999

[22] Filed: Jul. 27, 1999

[51] Int. Cl.[7] ..... B67D 5/00

[52] U.S. Cl. ..... 222/309; 222/43

[58] Field of Search ..... 222/43, 309, 380, 222/383.1, 384; 417/214, 519; 92/13.4; 137/625.41, 625.46

[56] References Cited

U.S. PATENT DOCUMENTS

| | | | |
|---|---|---|---|
| 981,661 | 1/1911 | Kupperle | 222/309 |
| 1,147,842 | 7/1915 | Bowser | 222/309 |
| 1,188,030 | 6/1916 | Bechtold | 92/13.4 |
| 1,352,270 | 9/1920 | Jefferson | 222/309 |
| 3,248,950 | 5/1966 | Pursell et al. | 222/309 |
| 3,321,108 | 5/1967 | Bowe | 222/309 |
| 4,964,534 | 10/1990 | Strazdins | 222/43 |

*Primary Examiner*—J. Casimer Jacyna
*Attorney, Agent, or Firm*—Oyen Wiggs Green & Mutala

[57] ABSTRACT

A paint colorant dispenser has a notched gauge rod on a stop member. The notched gauge rod can be easily replaced to change the units of measure for the paint colorant dispenser and is also inexpensive to manufacture. A double notch at an extreme end of the gauge rod facilitates accurate metering of small quantities of paint colorant. The dispenser has a spool valve which includes a resilient sealing member which is biased against an inner surface of a valve bore by a strong spring. The sealing member provides a good seal and accommodates wear without leakage. With the exception of the spring, the valve may be made of plastic. The valve does not need to be manufactured to extremely precise tolerances. The paint colorant dispenser has a wiper assembly coupled to operate with the valve. The wiper assembly includes a resiliently mounted wiper which closes off a lower end of the nozzle except when the valve is set to dispense paint colorant through the nozzle.

16 Claims, 9 Drawing Sheets

PAINT COLORANT DISPENSER WITH NOTCHED GAUGE ROD

TECHNICAL FIELD

This invention relates to an apparatus for dispensing accurately metered quantities of paint colorant for use in tinting paint.

BACKGROUND

Paint of virtually any color may be custom mixed by adding precisely measured amounts of one or more differently colored paint colorants to a base. The color of paints can be greatly affected by small variations in the amount of colorant added. Consequently, paint colorant dispensers must provide precise, repeatable, settings.

A paint colorant dispenser typically has a reservoir and a metering device which allows the user to accurately dispense a desired quantity of paint colorant. The reservoir is typically a canister capable of holding 1 or 2 liters of paint colorant. Manual paint colorant dispensers are commonly used in paint stores, hardware stores, and other establishments where small batches of colored paint are prepared. In such dispensers the metering device typically includes a pump having a piston movable within a measuring cylinder. A valve allows an operator to selectively place the interior of the measuring cylinder either in fluid communication with the paint colorant reservoir or in fluid communication with an outlet nozzle. An adjustable stop limits the travel of the piston within the measuring cylinder.

To dispense a measured quantity of paint colorant, an operator sets the stop at a position which corresponds to the desired quantity, sets the valve to place the interior of the measuring cylinder in fluid communication with the reservoir and then moves the piston along the measuring cylinder until it is prevented from travelling further by the stop. The operator then switches the valve to a dispensing position in which the interior of the measuring cylinder is in fluid communication with the outlet nozzle. Finally, the operator pushes the piston along the measuring cylinder to expel the measured quantity of paint colorant through the outlet nozzle. The amount of paint colorant dispensed is determined by the stroke of the piston (as limited by the stop) and the bore of the cylinder.

A typical paint coloring station has several (typically between 10 and 16) paint colorant dispensers each containing a different paint colorant so that a user can rapidly add precise amounts of several different paint colorants to a base to obtain a desired color.

One problem with existing paint colorant dispenser technology is that different units of measure are used in different parts of the world to measure volumes of paint colorant. To enable quick and accurate metering of paint colorants it is generally desirable that a paint colorant dispenser have a stop for which the discrete stop positions correspond to the locally used units of measure. Even in the same geographical region it may be desirable to provide different discrete stop locations for different colorants. For example, a more finely graduated stop might be desirable in a dispenser for paint colorants which are typically used in smaller quantities whereas a stop having fewer, more widely separated discrete positions might be desirable in a dispenser used for colorants which are typically used in larger quantities.

The need to provide stops which are calibrated in different units provides a difficulty for the manufacturers of paint colorant dispensers. Existing paint colorant dispensers have gauge rods having precisely located holes which define the stop positions. The gauge rods can be removed and replaced to alter the stop positions. Such gauge rods tend to be expensive to make. In some cases a gauge rod may have fifty or more holes. Making parts with a great many precisely located holes tends to be expensive even with modern manufacturing methods. Consequently, it is not possible to provide paint colorant dispensers which include interchangeable gauge rods as cost effectively as would be desired.

Another disadvantage of currently available paint colorant dispensing technology is that paint colorants can be very messy if they escape from containment. The valves in a paint colorant dispenser must be made very precisely to avoid any leakage of paint colorant. Manufacturing valve parts to very close tolerances is expensive. Even where valves are precisely made, some paint colorants are quite abrasive and tend to cause significant wear in valves. There is a need for a type of valve suitable for use with manual paint colorant dispensers which can operate smoothly and without leakage and yet is not unduly expensive to fabricate and service.

A further disadvantage of prior art manual paint colorant dispensers is that paint colorants, by their nature, are affected by contact with air and can dry out. Typically after paint has been dispensed through the dispensing nozzle of a paint colorant dispenser a small droplet of paint remains on the nozzle. More paint colorant remains inside the nozzle after paint colorant has been dispensed. There is a need for reliable means to seal off the nozzle of a paint colorant dispenser after use to prevent paint colorant within and adhering to the nozzle from drying out between uses.

A further problem with prior art paint dispensers is that typically the discrete stop positions do not provide fine enough increments in cases where it is necessary to dispense only very small quantities of paint colorant. Tinting formulae for making particular colors of paint typically specify the amounts of different colorants to add to one gallon of base material to achieve the desired colours. The amounts of each paint colorant in the formula must be proportionally reduced to tint a smaller amount of base material. For example, the amounts of colorant specified by a formula for making 1 gallon of paint must be divided by 8 if only one pint of paint is being tinted. As a result it is often necessary to accurately measure very small quantities of paint colorant.

In general, with a paint colorant dispenser having a stop which can be fixed only in discrete stop positions which permit dispensing paint colorant in multiples of one unit, it is not easily possible to dispense a fraction of a unit of paint colorant. For example, many paint colorant dispensers are calibrated in units of $1/48$ fluid ounce. With such paint colorant dispensers it is not easy to accurately dispense $1/96$ fluid ounce or $1/192$ fluid ounces of paint colorant. Some prior paint colorant dispensers approach the problem of accurately dispensing small amounts of paint colorant by requiring the user to replace a gauge rod in the stop assembly with a separate gauge rod. The separate gauge rod allows the stop to be fixed in a position which allows only a small volume of colorant to be dispensed. A problem with this approach is that the dispenser should be separately calibrated for use with the separate gauge rod. Also, the separate gauge rod is easily lost. Installing the separate gauge rod during the dispensing process introduces extra steps and raises the possibility of errors. Other paint colorant dispensers have a separate pump for dispensing small volumes. Both of these approaches significantly increase manufacturing costs.

SUMMARY OF THE INVENTION

This invention provides a paint colorant dispenser comprising a piston movable in a longitudinal direction within a measuring cylinder and a stop assembly for limiting the travel of the piston within the measuring cylinder. The stop assembly comprises a longitudinally movable stop member located to limit travel of the piston within the cylinder; a gauge rod on the stop member, the gauge rod having a plurality of notches spaced apart along a first edge thereof; and, a blade selectively engageable in a selected one of the notches. The gauge rod is preferably interchangeable. Providing an interchangeable gauge rod allows the paint colorant dispenser to be readily used to dispense paint colorant according to different systems of units. A gauge rod according to the invention may be sheared from a sheet of stiff material. Thus gauge rods according to the invention can be much more economical to manufacture than gauge rods which require many precisely located holes. The design provides a stop assembly which can largely be fabricated from suitable plastic materials, thereby further reducing costs.

Another aspect of the invention provides a stop assembly according to the invention which may be fitted to an existing paint colorant dispenser to limit travel of a piston within a measuring cylinder. The stop assembly comprises: a cap for a measuring cylinder, the cap receiving a longitudinally movable stop member; a gauge rod on the stop member, the gauge rod having a number of notches spaced apart along a first edge thereof; and, a blade on the cap, the blade selectively engageable in a selected one of the notches to lock the stop member in a position such that the stop member limits travel of the piston in the cylinder. A further aspect of the invention provides a notched gauge rod for use in paint colorant dispensers according to the invention.

BRIEF DESCRIPTION OF THE DRAWINGS

In drawings which illustrate non-limiting embodiments of the invention.

Figure 1:
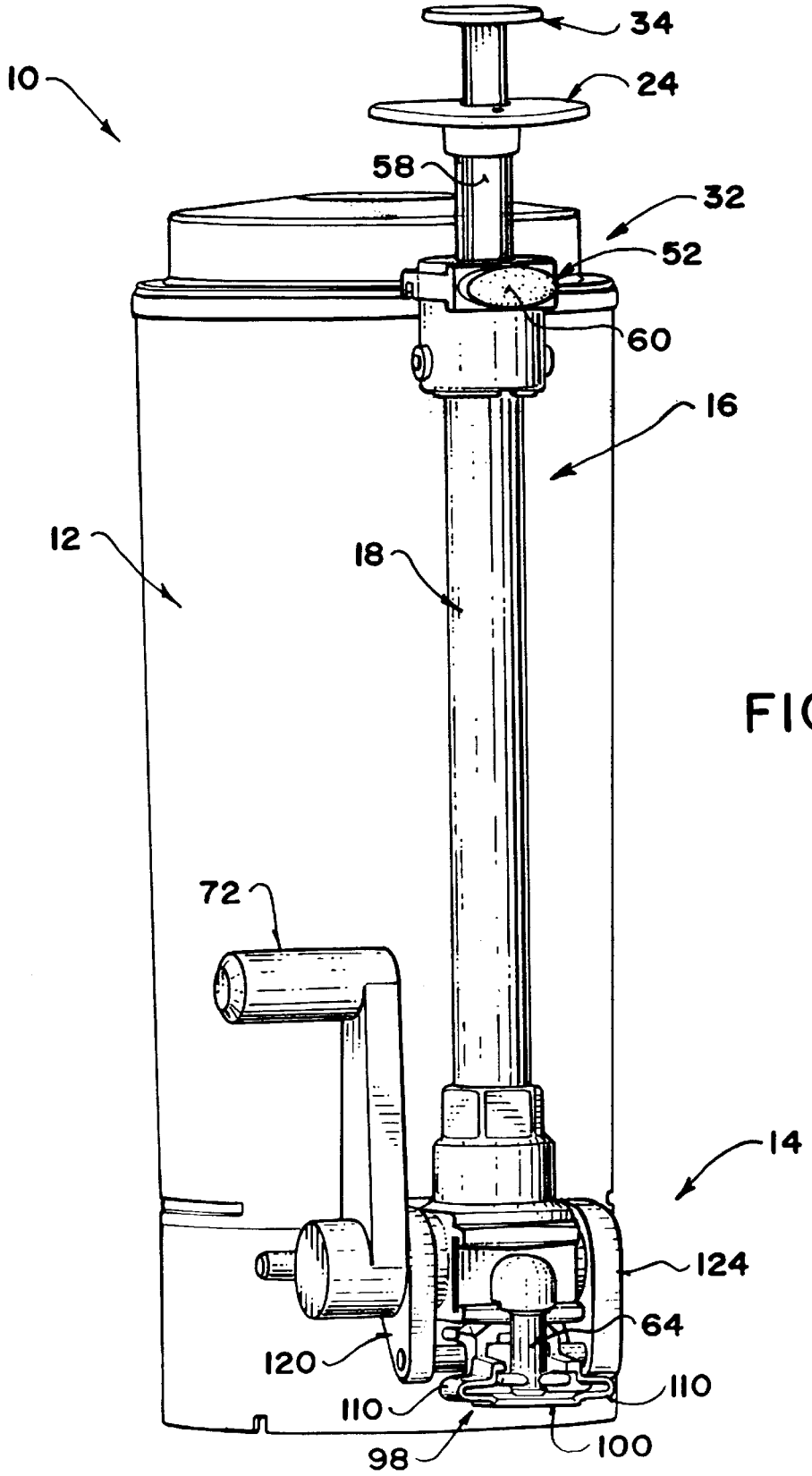
FIG. 1 is front isometric view of a paint colorant dispenser incorporating a wiper assembly according to the invention.

List of Reference Numerals Used in the Drawings

| | | | |
|---|---|---|---|
| 10 | paint colorant dispenser | 12 | canister |
| 14 | valve assembly | 16 | pump assembly |
| 18 | measuring cylinder | 20 | piston |
| 22 | piston rod | 24 | dispensing handle |
| 26 | seals | 30 | lower portion of measuring cylinder |
| 32 | stop assembly | 34 | stop member |
| 35 | projection | 36 | lower end of stop member |
| 40 | stop gauge rod | 42 | groove in stop member |
| 44 | bulges in gauge rod | 46 | alignment block |
| 46A | alignment notch | 48 | adjustment screw |
| 50 | notch | 50A | partial notch |
| 50B | small increment notch | 50C | adjacent notch |
| 51 | edge of gauge rod | 52 | stop locking assembly |
| 54 | stop locking blade | 56 | spring |
| 58 | scale | 60 | stop locking button |
| 62 | spring | 62' | spring |
| 64 | nozzle | 66 | valve spool |
| 70 | valve bore | 72 | valve operating handle |
| 74 | sealing member | 76 | groove |
| 78 | valve spring | 80 | nozzle port |
| 84 | canister port | 86 | pump port |
| 88 | indentations | 89 | projections |
| 90 | seals | 92 | O-rings |
| 94 | O-ring grooves | 98 | wiper assembly |
| 100 | wiper | 104 | track |
| 106 | arrow | 110 | resilient side portion |
| 112 | inclined portion | 114 | wings |
| 116 | grooves | 118 | ramped portion |
| 120 | lever | 124 | lever |
| 126 | block | 130 | cavity |

DESCRIPTION

Figure 2:
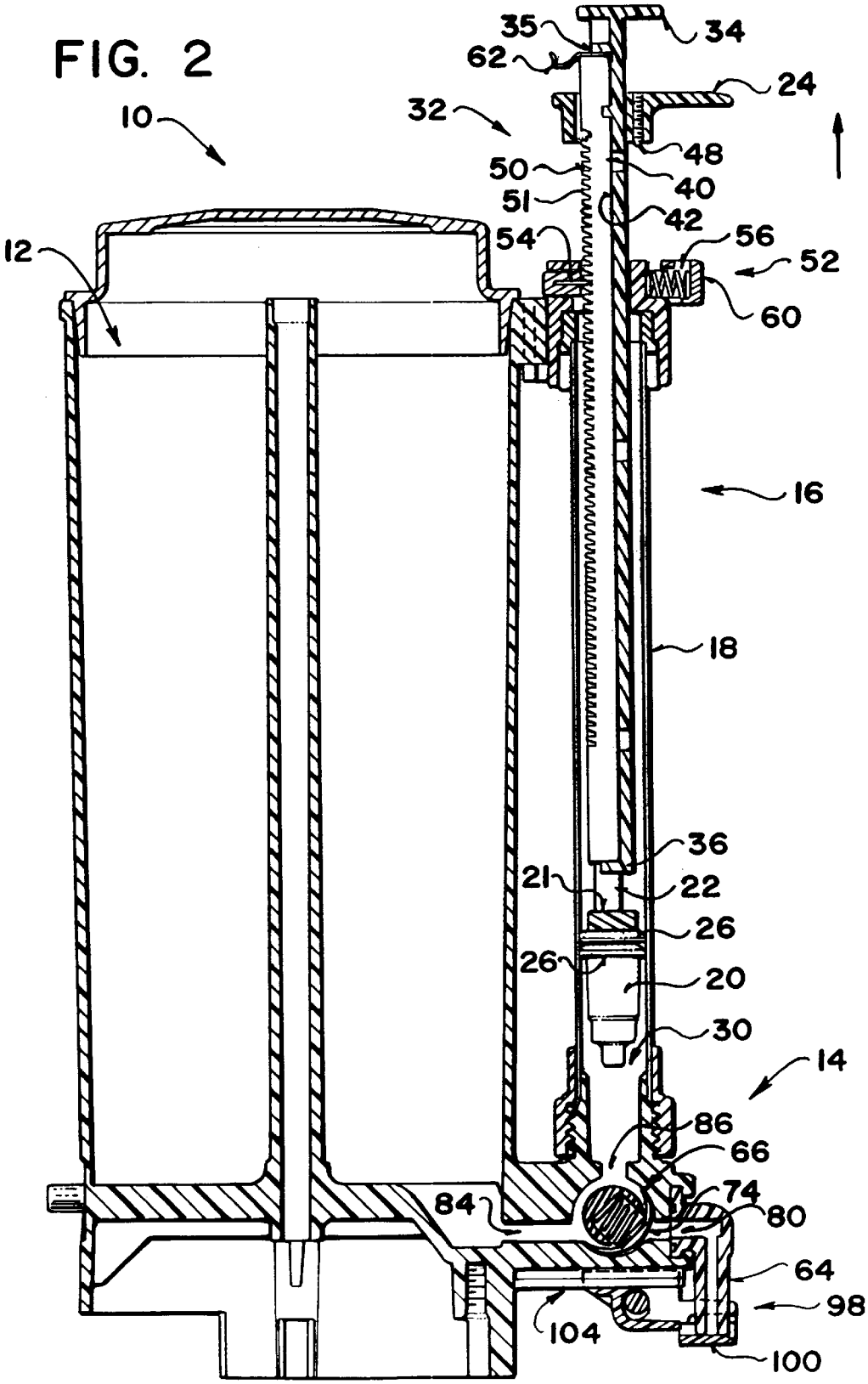
FIG. 2 is a section through the paint colorant dispenser of FIG. 1 in which some elements have not been sectioned for clarity.

As shown in FIGS. 1 and 2, a paint colorant dispenser 10 has a canister 12 which provides a reservoir for paint colorant. A metering device comprising a valve assembly 14 and a pump assembly 16 is connected to canister 12. Canister 12 typically includes an agitator (not shown) for stirring the paint colorant within canister 12.

Pump assembly 16 comprises a measuring cylinder 18 and a piston 20 which is slidably and sealingly mounted inside measuring cylinder 18. A piston rod 22 connects piston 20 to a handle 24. Piston 20 has suitable seals 26 so that paint colorant is confined to a lower portion 30 of measuring cylinder 18 between piston 20 and valve assembly 14. An operating handle 24 is mounted at the upper end of piston rod 22. By grasping handle 24 and moving it vertically a user can move piston 20 in measuring cylinder 18 to vary the volume of lower portion 30.

The travel of piston 20 within measuring cylinder 18 is limited by a stop assembly 32. A user can lift operating handle 24 only until stop assembly 32 prevents further travel of piston 20. Stop assembly 32 comprises a movable stop member 34. In the illustrated embodiment, there are two piston rods 22 which connect operating handle 24 to piston 20. Stop member 34 is T-shaped in section, fits through a T-shaped aperture in operating handle 24 and extends into measuring cylinder 18 between piston rods 22. The stroke of piston 20, and, therefore, the quantity of paint colorant dispensed in a single stroke of piston 20 can be adjusted by moving stop member 34 upwardly or downwardly to a position where a stroke of piston 20 will dispense the desired amount of paint colorant. When stop member 34 is in position the stroke of piston 20 is limited by projections 35 on stop member 34 which block passage of operating handle 24. In the alternative, a lower end 36 of stop member 34 could provide a definite limit to the travel of piston 20. When stop member 34 is positioned to allow a desired amount of paint colorant to be dispensed then stop member 34 is locked in place as described below.

Stop assembly 32 comprises a gauge rod 40. Gauge rod 40 is removably attachable to stop member 34. In the illustrated embodiment, gauge rod 40 is received within a groove 42 in stop member 34. Stop gauge rod 40 may be held in place within groove 42 by stamped bulges 44 which snap into place in recesses (not shown) within groove 42. An alignment block 46 in stop member 34 is received in a notch 46A in gauge rod 40. Block 46 and notch 46A preserve vertical alignment between gauge rod 40 and stop member 34. An adjustment screw 48 in operating handle 20 allows fine adjustment of the stroke of piston 20.

Gauge rod 40 comprises a number of notches 50 equally spaced apart along one of its edges 51. A stop locking assembly 52 comprising a blade 54 is mounted to measuring cylinder 18. Blade 54 is biased into engagement with edge 51 of gauge rod 40 by a spring 56. Stop member 34 is prevented from moving when blade 54 is engaged in a notch 50. By engaging blade 54 in a particular one of notches 50 the volume of paint colorant dispensed in a single stroke of piston 20 can be set at a desired amount. A scale 58 on a front surface of stop member 32 indicates the number of units of paint colorant which will be dispensed in a stroke of piston 20, as limited by the current position of stop member 34. In the preferred embodiment, when operating handle 24 is in its lowermost position, the top of operating handle 24 intersects scale 58 at an indicia which indicates the number of units of paint colorant which will be dispensed in a stroke of piston 20.

A user can adjust the position of stop member 34 by depressing a stop locking button 60 which moves blade 54 rearwardly, out of engagement with notches 50. Stop member 34 can then be freely adjusted upwardly or downwardly to a desired position.

The set of available discrete positions in which stop member 34 can be locked can be changed by simply removing gauge rod 40 and replacing gauge rod 40 with another gauge rod 40 having differently spaced notches 50. A particular advantage of the illustrated design is that stop gauge rod 40, including notches 50 may be accurately stamped, in a single operation, from a sheet of a suitable material such as steel. A gauge rod 40 as illustrated in the drawings is far less expensive to manufacture than a gauge rod which has a large number of precisely located holes.

Paint colorant dispenser 10 is capable of accurately metering small quantities of paint colorant. Moving stop member 34 from one discrete position to an adjacent discrete position (i.e. moving blade 54 from one notch 50 into an adjacent notch 50) varies the amount of paint colorant dispensed by one unit of volume. Stop assembly 32 of paint colorant dispenser 10 can be set to dispense one half of a unit or one quarter of a unit of paint colorant.

Figure 6:
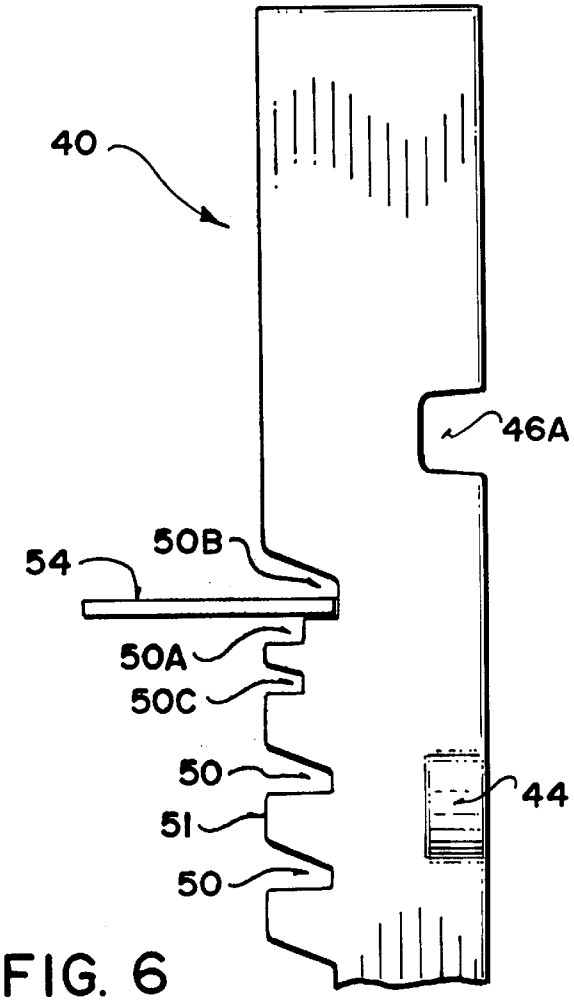
FIGS. 5 and 6 are details illustrating configurations of the stop locking mechanism sets to dispense small quantities of paint colorant.
Figure 5:
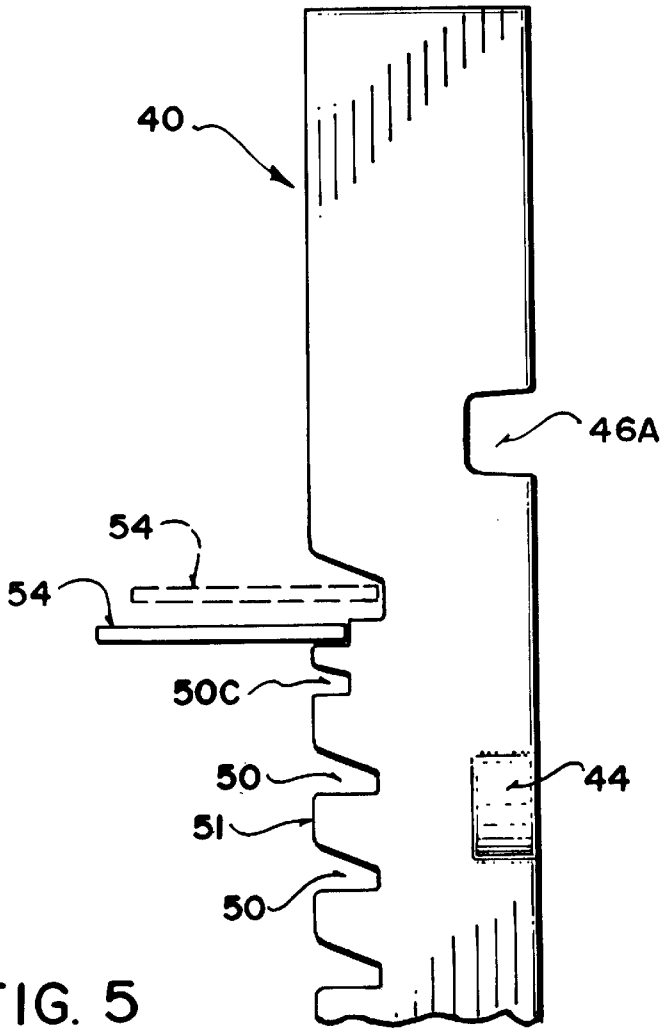
Figure 7:
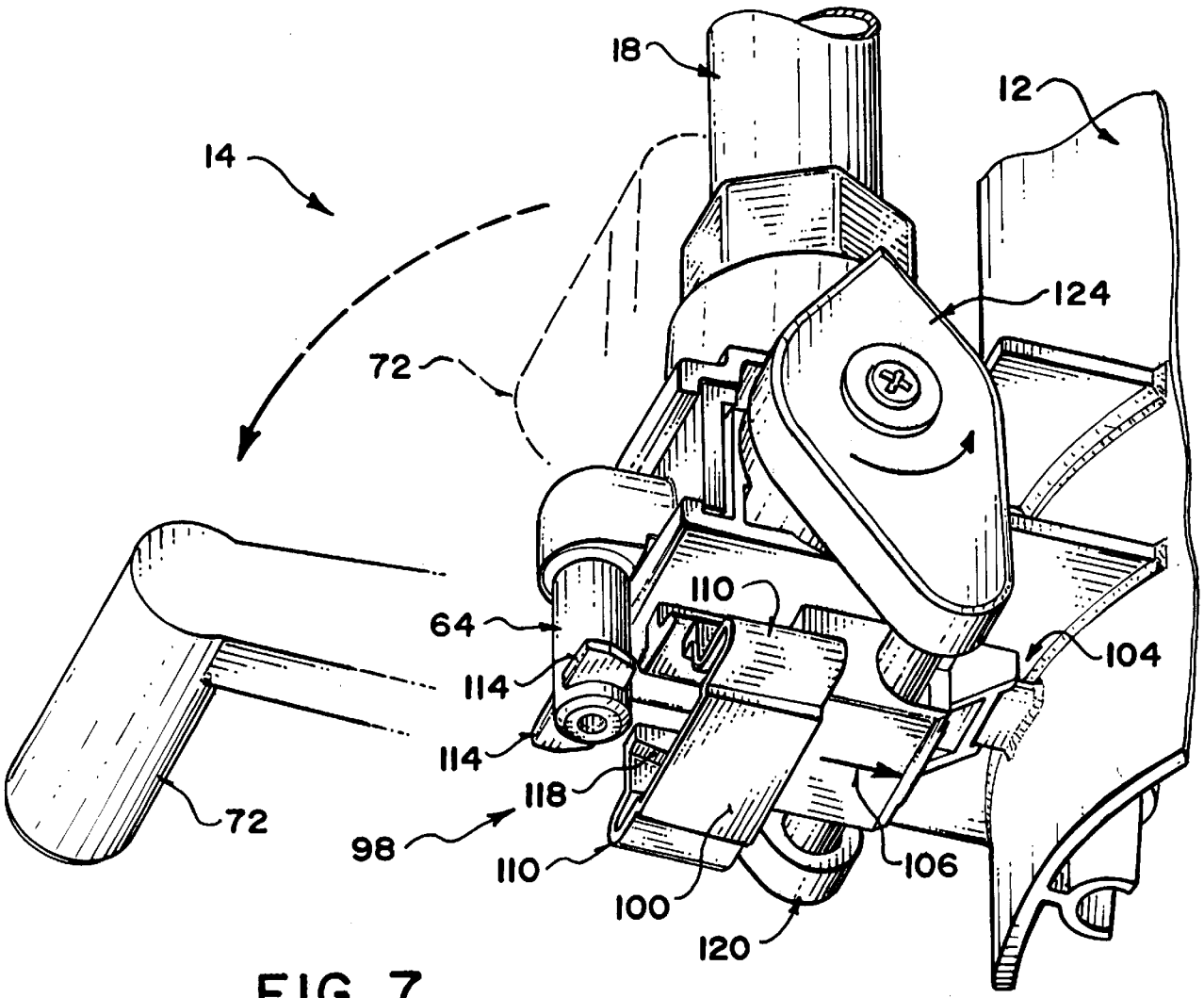
FIG. 7 is an isometric view looking up from below a nozzle assembly in a paint colorant dispenser according to the invention.
Figure 8:
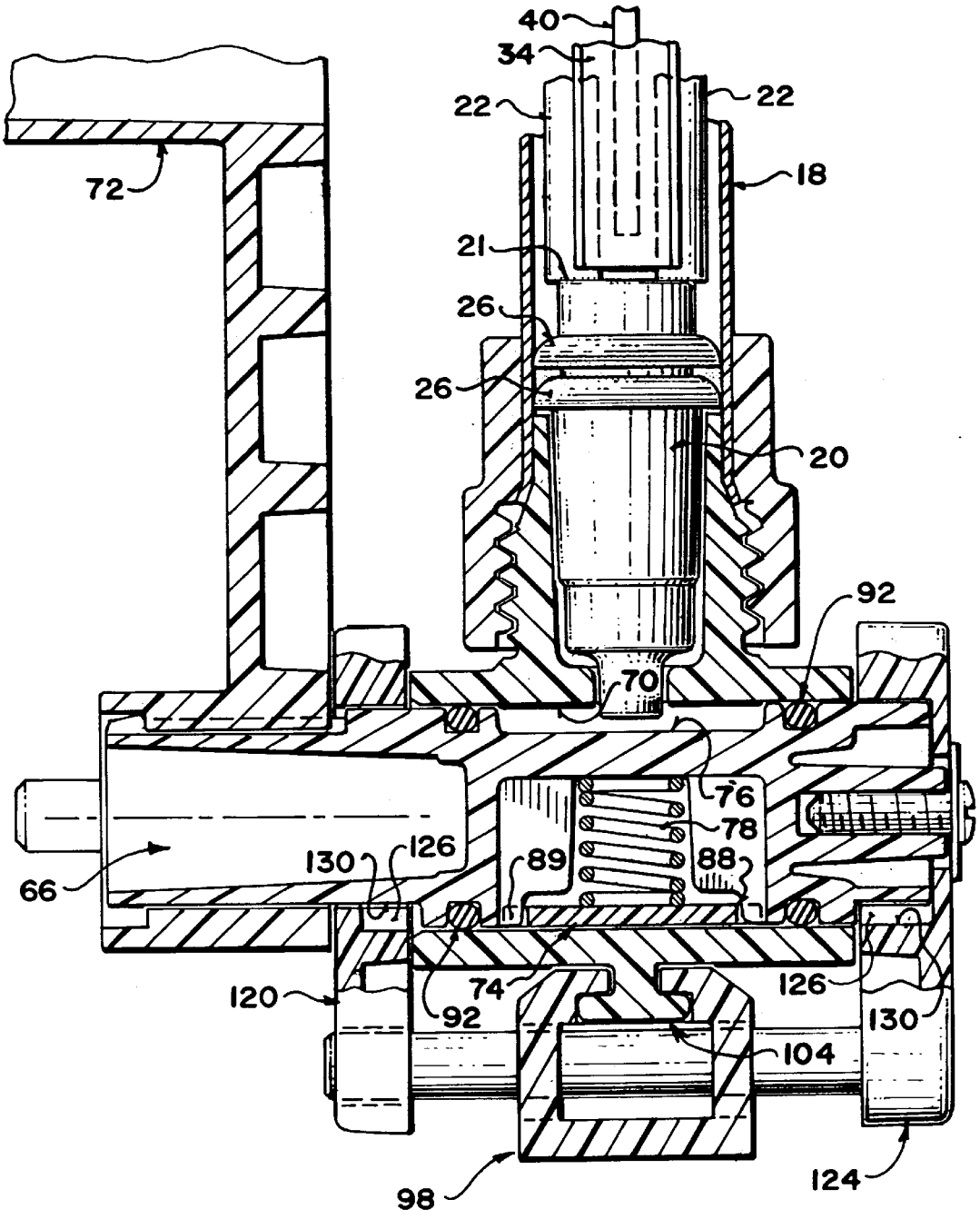
FIG. 8 is a section through a valve and nozzle portion of the dispensing mechanism of a paint colorant dispenser according to the invention in a plane perpendicular to the section of FIG. 2.

The invention provides a novel way to dispense small volumes of paint colorant. As shown best in FIGS. 5 and 6, gauge rod 40 has an uppermost notch which comprises a partial notch 50A on the side of a deeper notch 50B. As shown in FIGS. 5 and 6, partial notch 50A comprises a recess capable of receiving blade 54 in one wall of deeper notch 50B.

An adjacent notch 50C is smaller than other notches 50 so that it does not interfere with partial notch 50A. When blade 54 is engaged in partial notch 50A, as shown in FIG. 5, the travel of piston 20 is limited so that a small amount, for example, one half unit of paint colorant is dispensed in a stroke of piston 20. When blade 54 is engaged in notch 50B, as shown in FIG. 6, then a still smaller amount, for example, one quarter of a unit of paint colorant is dispensed in each stroke of piston 20. Partial notch 50A preferably has a back surface which is flat or else contoured in some other way such that blade 54 does not tend to slip out of engagement with partial notch 50A but blade 54 can slip into deeper notch 50B if stop member 34 is displaced downwardly while blade 54 is engaged in partial notch 50A.

Figure 3:
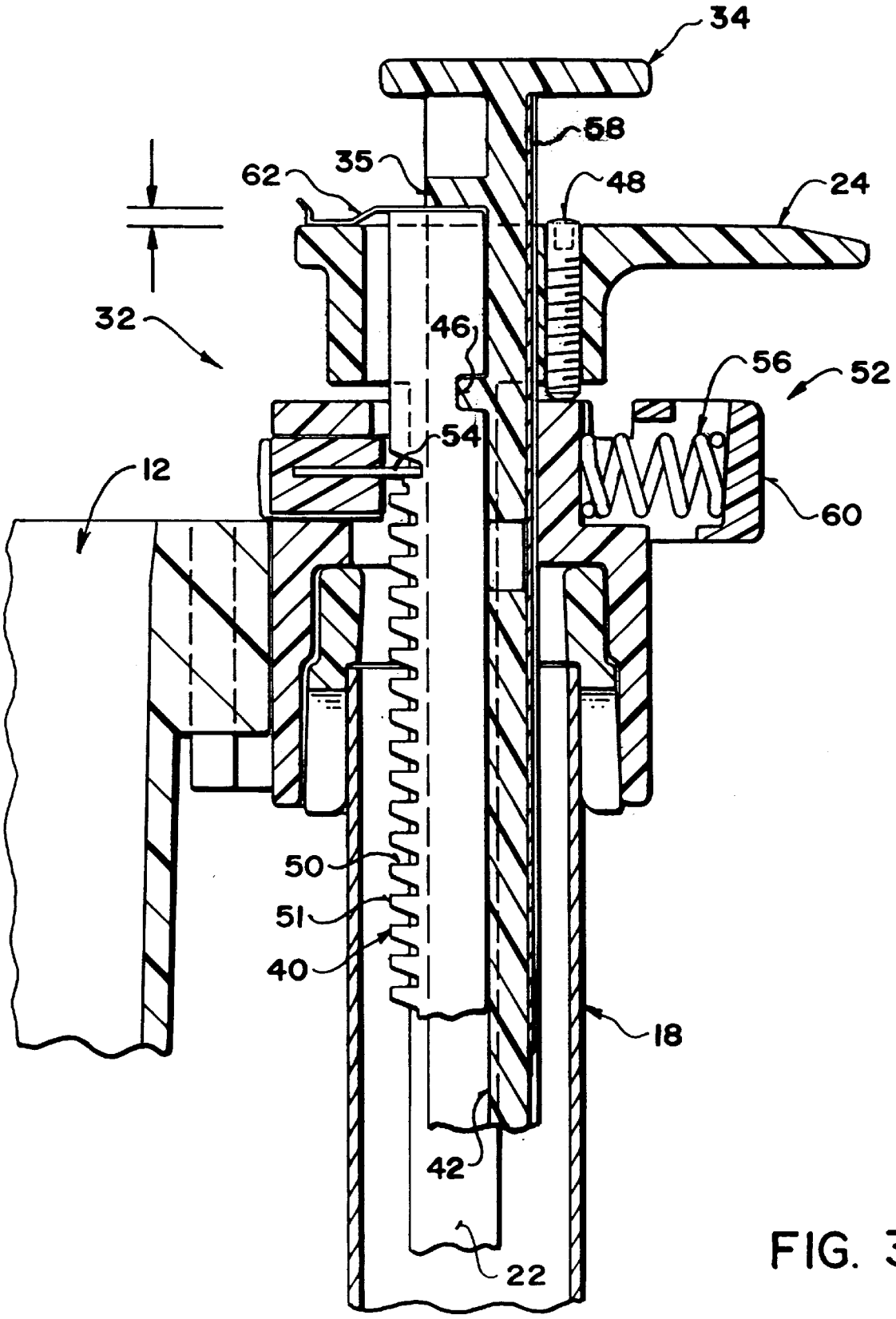
FIG. 3 is a section through a locking mechanism for the stop assembly of this invention.

A spring 62 is provided on stop member 34. Spring 62 biases gauge rod 40 against blade 54 when blade 54 is engaged in partial notch 50A. This prevents stop member 34 from dropping downwardly. If stop member 34 were not prevented from dropping downwardly then blade 54 could slide out of partial notch 50A into deeper notch 50B. In the illustrated embodiments, spring 62 is mounted on stop member 34. In the embodiment of FIGS. 2 and 3, spring 62 is mounted at an upper end of stop member 54 and is located so that it begins to bear against the upper end of operating handle 24 as stop member 34 is lowered into a position where blade 54 can be engaged with partial notch 50A.

Figure 11:
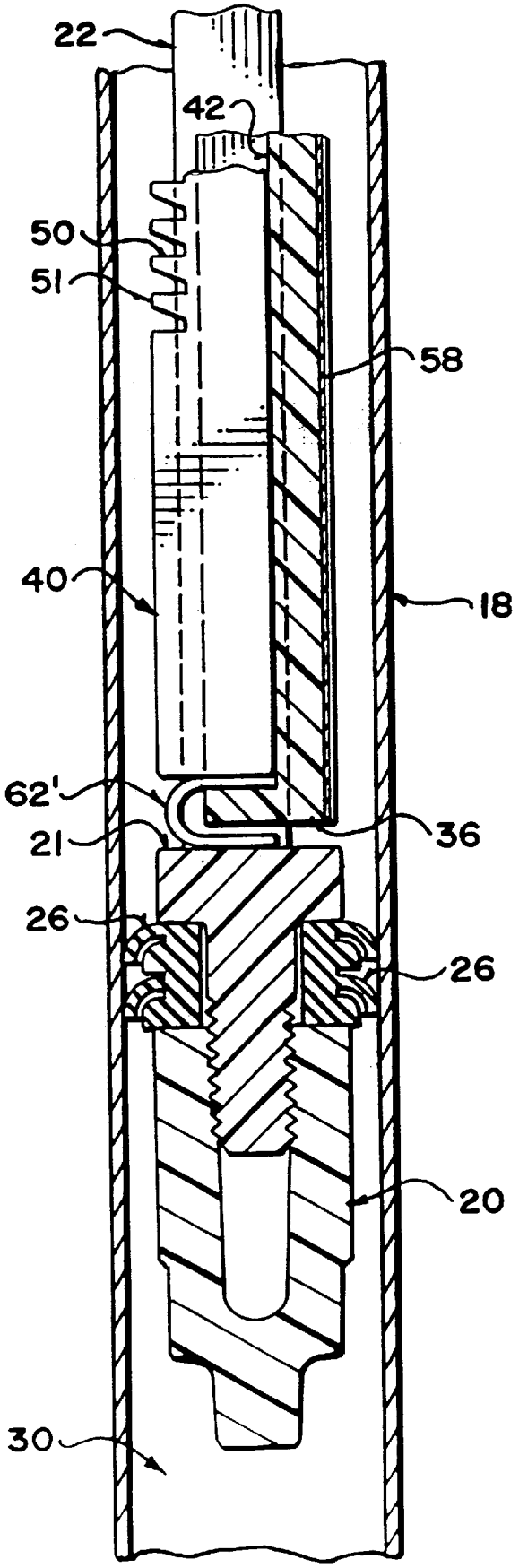

In the embodiment of FIG. 11, spring 62' is U-shaped and is mounted to lower end 36 of stop member 34. Spring 62' bears against piston 20 so as to bias stop member 34 upwardly when blade 54 is engaged in partial notch 50A. In the embodiment of FIG. 11 spring 62' is protected inside measuring cylinder 18 and is not likely to snag a user's clothing or become damaged in use.

Spring 62 (or 62') facilitates setting stop assembly 32 for dispensing ½ unit of paint colorant. A user can push stop release button 60, and, with dispensing handle 24 in its lowermost position, depress stop member 34 until spring 62 (or 62') bears against the top of dispensing handle 24 (or the top of piston 20). The user can then release stop release button 60 to allow blade 54 to engage partial notch 50A.

If the user wishes to dispense only ¼ unit of paint colorant then a user can set stop assembly 32 to dispense ½ unit of paint colorant, as described above, and then the user can push down on stop member 34 against the action of spring 62 (or 62') until blade 54 snaps into position in notch 50B. In the alternative, the user can depress stop release button 60, push stop member 34 fully downwardly and then release stop release button 60 so that blade 54 engages notch 50B. Notch 50B is wider than other notches 50 so that blade 54 can enter notch 50B even when stop member 34 is in its lowermost position. It is not necessary that the small increments of paint colorant to be dispensed are ½ unit or ¼ unit. Notches 50A and 50B could be located to allow stop member 32 to be positioned to allow, for example, one third or two thirds of a unit of paint colorant to be dispensed.

Figure 4:
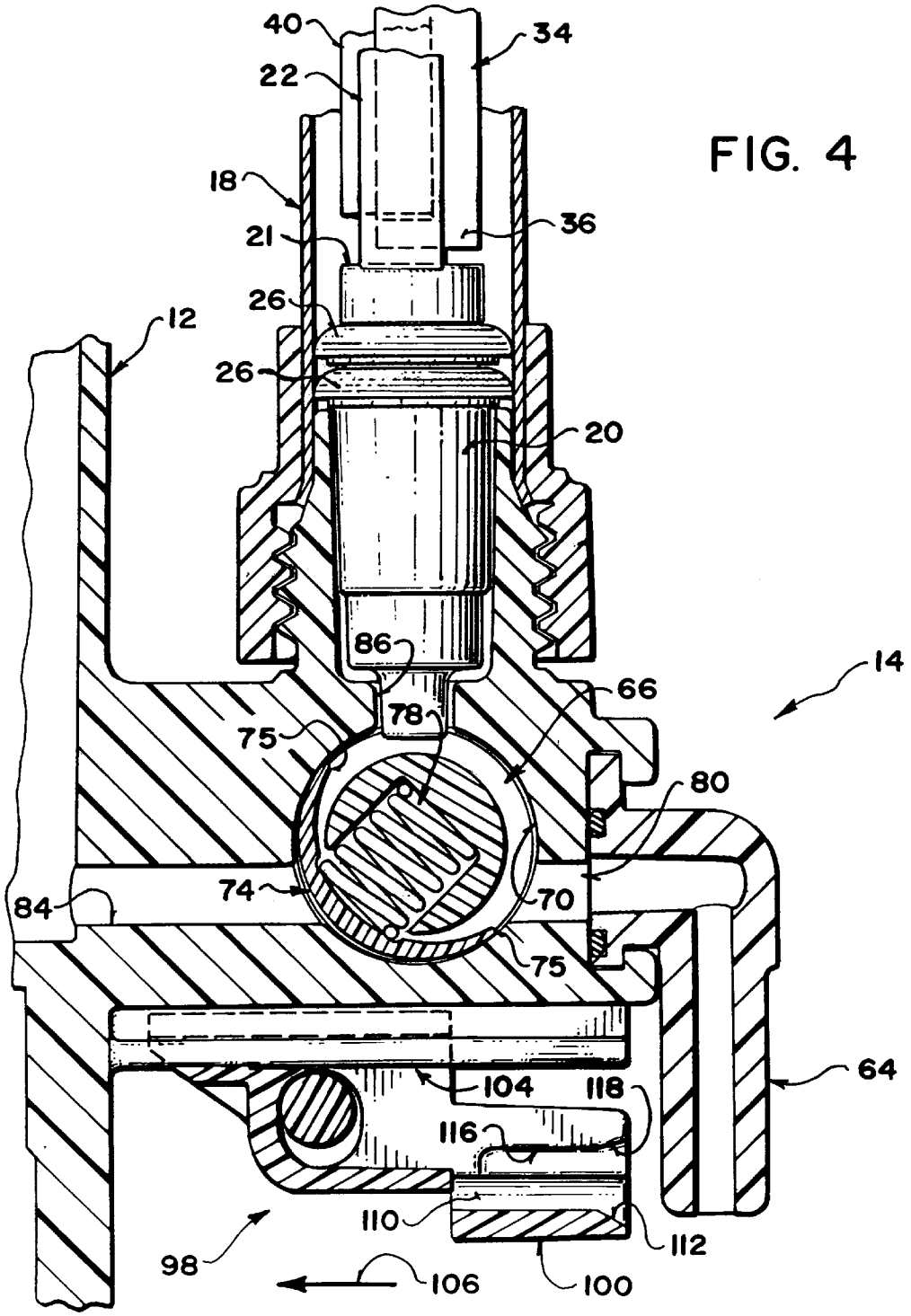
FIG. 4 is a section through a valve and nozzle portion of the dispensing mechanism of the invention.

Paint colorant dispenser 10 can be used to dispense a measured quantity of paint colorant from canister 12 by setting stop assembly 32 in a position corresponding to the desired measured quantity and placing valve assembly 14 in a configuration such that canister 12 is in fluid communication with measuring cylinder 18 (as shown in FIG. 2). A measured quantity of paint colorant can then be drawn into measuring cylinder 18 by lifting operating handle 24 to draw piston 20 upwardly from its lowermost position within measuring cylinder 18 until stop member 34 prevents further travel of piston 20. As piston 20 is raised, paint colorant is drawn from canister 12, through valve assembly 14 into lower portion 30. The volume of paint colorant drawn into measuring cylinder 18 depends upon the diameter of measuring cylinder 18 and the stroke of piston 20. When the desired quantity of paint colorant has been drawn into measuring cylinder 18 then valve assembly 14 may be set so that measuring cylinder 18 is in fluid communication with a nozzle 64 (as shown in FIG. 4). The paint colorant can then be dispensed from measuring cylinder 18 through nozzle 64.

Valve assembly 14 is then configured so that measuring cylinder 18 is in fluid communication with nozzle 64. When a user subsequently lowers piston 20 by depressing operating handle 24 the paint colorant filling lower portion 30 is forced through valve assembly 14 and expelled through nozzle 64.

Paint colorant dispenser 10 comprises a valve assembly 14 which alleviates the problems of valve leakage and valve wear. Valve assembly 14 comprises a valve spool 66 which is received within a valve bore 70. Spool 66 may be rotated about its axis within bore 70 by means of valve operating handle 72. Spool 66 carries a sealing member 74 on its outer surface and has a circumferentially extending groove 76. Sealing member 74 is biased by a strong valve spring 78 so that it bears tightly against the inner surface of valve bore 70. Valve spring 78 preferably has a spring constant on the order of 130 pounds/inch.

In a first position, as shown in FIG. 2, sealing member 74 blocks a nozzle port 80 which connects valve bore 70 to nozzle 64 and permits paint colorant to flow from canister 12 into lower portion 30 through a canister port 84, groove 76 and a pump port 86. Canister port 84 may be called a "first" port, pump port 86 may be called a "second" port and nozzle port 80 may be called a "third" port. In a second position, which is illustrated in FIG. 4, sealing member 74 blocks canister port 84 and a places nozzle 64 in fluid communication with lower portion 30 by way of pump port 86, groove 76 and nozzle port 80.

Because strong spring 78 is continuously biasing sealing member 74 against inner surfaces of valve bore 70, valve assembly 14 continues to provide good sealing even if some wear occurs on sealing member 74 and/or on valve bore 70. Sealing member 74 and valve bore 70 may both be made of the same plastic material. Acetal or Delrin™ are good materials for sealing member 74 because of their desirable wear, bearing and resilience properties.

Preferably sealing member 74 is resilient and has edge portions which are thinner than its central portion. Sealing member 74 is preferably made of plastic. Most preferably when sealing member 74 is not being exposed to any external forces (i.e. is "undeflected") the outer surface of sealing member 74 has a radius of curvature slightly greater than that of valve bore 70. Spring 78 causes sealing member 74 to flex as it forces the central portion of sealing member 74 against the interior of valve bore 70. This insures a large area of contact between sealing member 74 and valve bore 70.

Figure 10:
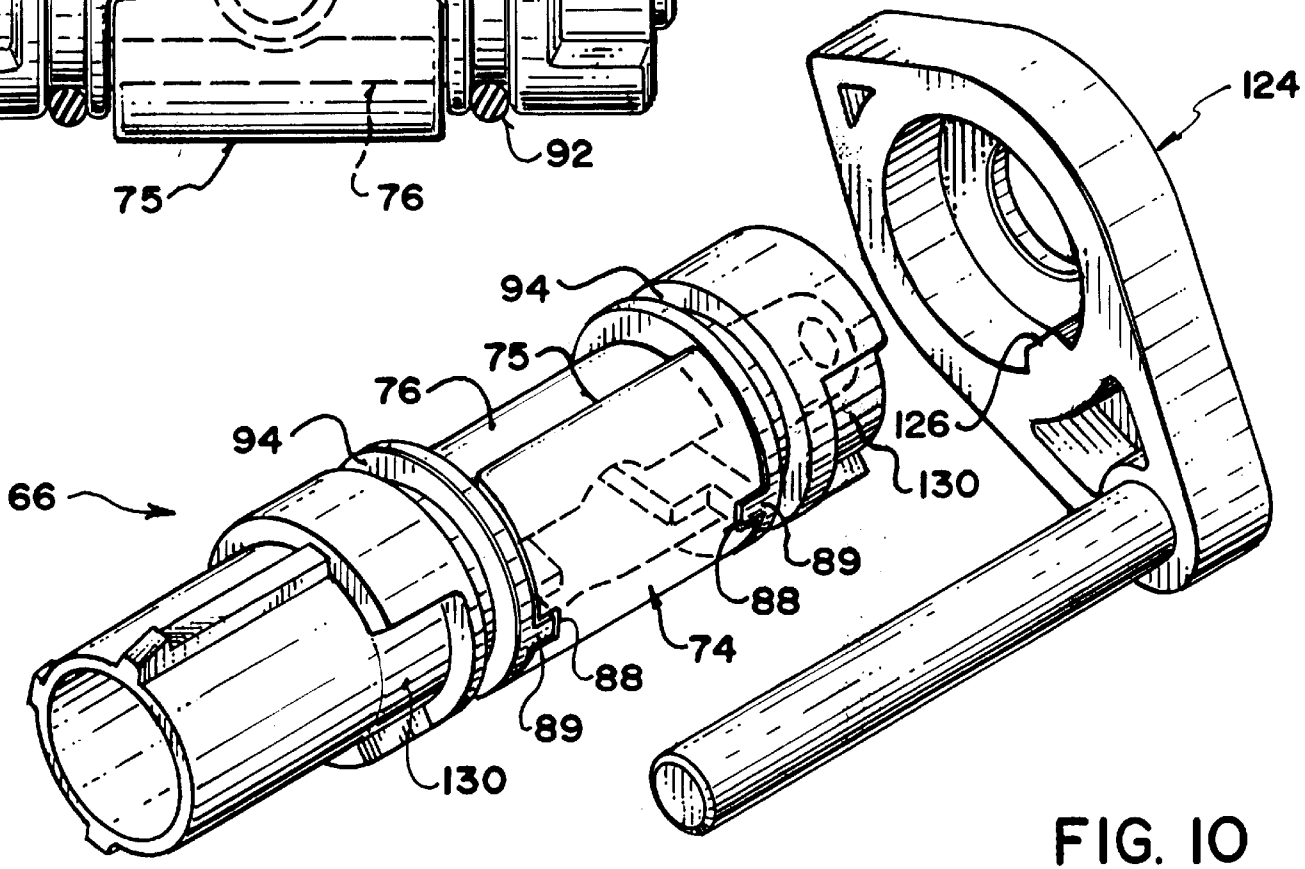
FIG. 10 is an isometric view of a valve member from a paint colorant dispenser according to the invention; and, FIG. 11 shows a stop member equipped with an alternative spring.
Figure 9:
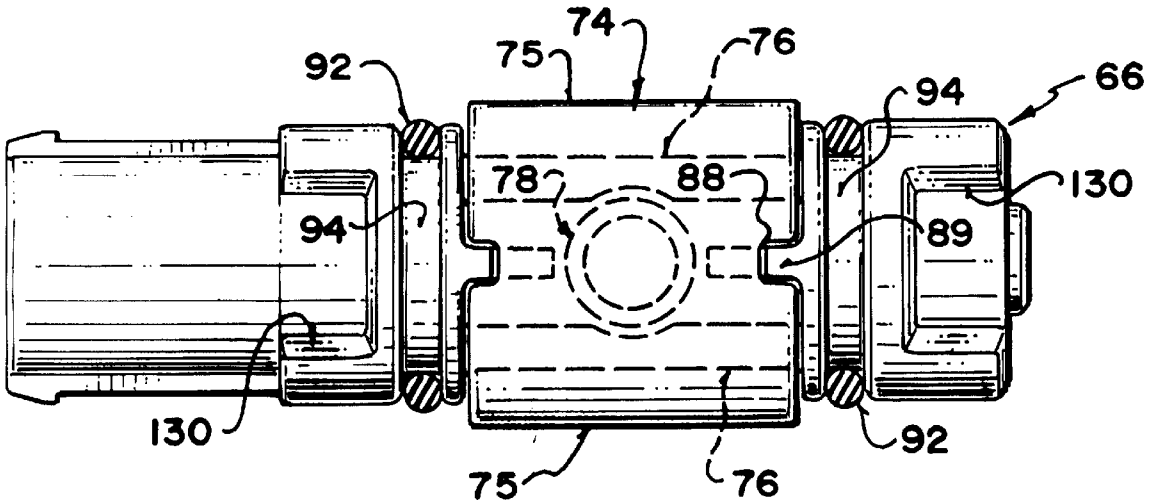
FIG. 9 is a plan view of a valve member for use in the invention.

As shown best in FIGS. 9 and 10, sealing member 74 has indentations 88 which engage projections 89 in valve spool 66. This prevents sealing member 74 from slipping relative to valve spool 66 as valve spool 66 is rotated within bore 70. End seals 90 which comprise o-rings 92 received within grooves 94 in valve spool 66 are provided to prevent axial leakage of paint colorant from valve bore 70.

A further feature of paint colorant dispenser 10 is the wiper assembly 98 which comprises a wiper 100 which seals the bottom of nozzle 64 at times when paint colorant is not being dispensed through nozzle 64. Wiper assembly 98 can slide inwardly or outwardly along a track 104 as indicated by arrow 106. When handle 72 is in its first position, as shown in FIG. 2, wiper 100 covers the exit of nozzle 64. As valve handle 72 is moved from its first position to its second position wiper assembly 98 is pulled inwardly, thereby exposing the end of nozzle 64.

Wiper 100 is suspended from resilient side portions 110 and has an inclined portion 112 on its front surface. Side portions 110 are preferably U-shaped sections of resilient plastic. Most preferably wiper assembly 98 comprises a single unitary plastic part. When handle 72 is moved from its second position back to its first position wiper 100 approaches nozzle 64. As inclined portion 112 encounters nozzle 64 wiper 100 is forced downwardly against the resilient action of resilient side portions 110. Wiper 100 continues to move until handle 72 is back in its first position. At this point, wiper 100 once again covers the lower end of nozzle 64 and resilient side portions 110 hold wiper 100 in tight contact with the lower end of nozzle 64.

Nozzle 64 has wing portions 114. Wing portions 114 engage in grooves 116 which are located on wiper assembly 98 above resilient side portions 110. Wings 114 hold the upper portion of wiper assembly in position to insure that wiper 100 will be biased against the lower end of nozzle 64 with sufficient force to provide a good seal. Forward ends 118 of grooves 116 are ramped so that wings 114 tend to push wiper assembly 98 upwardly as wiper 100 moves back in a direction opposite to arrow 106 to cover the lower end of nozzle 64.

Wiper assembly 98 is linked to valve operating handle 72 by a linkage which allows wiper 100 to continue to completely cover the lower end of nozzle 64 until valve operating handle 72 is nearly in its second position. In the illustrated embodiment, the linkage connecting wiper 100 to valve operating handle 72 comprises a pair of operating levers 120 and 124 which are mounted on either end of valve spool 66. Each of operating levers 120 and 124 has a block 126 which engages a circumferentially extending cavity 130 in valve spool 66. As handle 72 is moved from its first position toward its second position, operating levers 120 and 124 initially do not move. Eventually, for example when valve operating handle 72 is about 30 degrees away from its second position, blocks 126 abut against the ends of circumferentially extending cavities 130. Further motion of valve operating handle 72 causes operating levers 120 and 124 to pull wiper assembly 100 inwardly, away from nozzle 64.

A paint colorant dispenser 10 according to the invention may be made almost entirely of plastic. Only gauge rod 40, blade 54, springs 56, 62 and 78, any necessary screw fasteners and measuring cylinder 18 are preferably fabricated of metal.

As will be apparent to those skilled in the art in the light of the foregoing disclosure, many alterations and modifications are possible in the practice of this invention without departing from the spirit or scope thereof. By way of example only, springs 62 and 62' have been provided as bias means for biasing stop member 34 away from piston 20. Springs 62 and 62' do not need to be connected to stop member 34 but could be mounted on adjacent structures. Spring 62 or 62' could have a different shape from the shapes illustrated. Springs 62 and 62' could, for example, be replaced by a coil spring received in a well in an upper end of piston 20. Another suitable bias means could be used in place of springs 62 and 62'. Accordingly, the scope of the invention is to be construed in accordance with the substance defined by the following claims.

What is claimed is:

1. A paint colorant dispenser comprising:

a) a piston movable in a longitudinal direction within a measuring cylinder;

b) a stop assembly comprising:

i) a longitudinally movable elongated stop member capable of being fixed in position relative to the measuring cylinder and located to limit a range of travel of the piston within the cylinder;

ii) a gauge rod extending along and detachably affixed to the stop member, the gauge rod having a plurality of notches spaced apart along a first edge thereof; and, iii) a blade selectively engageable in a selected one of the notches;

wherein, when the blade is engaged in one of the notches, the stop member is held in a position such that a stroke of the piston in the measuring cylinder through the range limited by the stop member causes a desired amount of paint colorant to be dispensed.

2. A paint colorant dispenser comprising:

a) a piston movable in a longitudinal direction within a measuring cylinder;

b) a stop assembly comprising:

i) a longitudinally movable stop member located to limit a range of travel of the piston within the cylinder;

ii) a gauge rod detachably affixed in a longitudinal groove in the stop member, the gauge rod having a plurality of notches spaced apart along a first edge thereof; and, iii) a blade selectively engageable in a selected one of the notches;

wherein, when the blade is engaged in one of the notches, the stop member is held in a position such that a stroke of the piston in the measuring cylinder through the range limited by the stop member causes a desired amount of paint colorant to be dispensed.

3. A paint colorant dispenser comprising:

a) a piston movable in a longitudinal direction within a measuring cylinder;

b) a stop assembly comprising:

i) a longitudinally movable stop member located to limit travel of the piston within the cylinder;

ii) a gauge rod detachably affixed in a longitudinal groove on the stop member, the gauge rod having a plurality of notches spaced apart along a first edge thereof, and a locating notch on a second edge thereof, such that when the gauge rod is affixed in the groove, and alignment block on the stop member engages the locating notch; and, iii) a blade selectively engageable in a selected one of the notches;

wherein, when the blade is engaged in one of the notches, the stop member is held in a position such that a stroke of the piston in the measuring cylinder causes a desired amount of paint colorant to be dispensed.

4. A paint colorant dispenser comprising:

a) a piston movable in a longitudinal direction within a measuring cylinder;

b) a stop assembly comprising:

i) a longitudinally movable stop member located to limit travel of the piston within the cylinder;

ii) a plurality of interchangeable gauge rods, in each of the interchangeable gauge rods the notches of the plurality of notches are equally spaced apart by a different distance, wherein each of the interchangeable gauge rods is capable of being detachably affixed in a longitudinal groove in the stop member and, iii) a blade selectively engageable in a selected one of the notches;

wherein, when the blade is engaged in one of the notches, the stop member is held in a position such that a stroke of the piston in the measuring cylinder causes a desired amount of paint colorant to be dispensed.

5. A paint colorant dispenser comprising:

a) a piston movable in a longitudinal direction within a measuring cylinder;

b) a stop assembly comprising:

i) a longitudinally movable stop member located to limit travel of the piston within the cylinder;

ii) a gauge rod on the stop member, the gauge rod having a plurality of notches spaced apart along a first edge thereof, wherein one of the notches in the gauge rod has a partial notch in a side portion thereof; and, iii) a blade selectively engageable in a selected one of the notches;

wherein, when the blade is engaged in one of the notches, the stop member is held in a position such that a stroke of the piston in the measuring cylinder causes a desired amount of paint colorant to be dispensed.

6. The paint colorant dispenser of claim 5 comprising a spring located to urge the side portion against the stop member when the blade is in the partial notch.

7. The paint colorant dispenser of claim 6 wherein the spring is on an end of the stop member between the stop member and the piston.

8. The paint colorant dispenser of claim 7 wherein the spring is a U-shaped spring.

9. The paint colorant dispenser of claim 5 wherein the number of notches are equally spaced apart by a first distance and the partial notch is spaced along the edge of the gauge rod from the one notch by a fraction of the first distance.

10. The paint colorant dispenser of claim 9 wherein the fraction is ½.

11. The paint colorant dispenser of claim 9 wherein the fraction is ¼.

12. A paint colorant dispenser comprising:

a) a piston movable in a longitudinal direction within a measuring cylinder wherein the piston is coupled to an operating knob at an upper end of the measuring cylinder, by a pair of parallel spaced apart piston rods;

b) a stop assembly comprising:

i) a longitudinally movable stop member located to limit travel of the piston within the cylinder;

ii) a gauge rod on the stop member, the gauge rod having a plurality of notches spaced apart along a first edge thereof; and, iii) a blade selectively engageable in a selected one of the notches;

wherein, when the blade is engaged in one of the notches, the stop member is held in a position such that a stroke of the piston in the measuring cylinder causes a desired amount of paint colorant to be dispensed.

13. The paint colorant dispenser of claim 12 wherein the stop member extends between the piston rods.

14. The paint colorant dispenser of claim 13 wherein the stop member is T-shaped in cross section and the gauge rod is detachably affixed in a longitudinal groove in an arm of the stop member which extends between the piston rods.

15. The paint colorant dispenser of claim 14 comprising a scale on a front face of the stop member, the operating knob indicating on the scale an amount of paint to be dispensed for the current setting of the stop member.

16. A stop assembly for fitting to a paint colorant dispenser to limit a range of travel of a piston within a measuring cylinder, the stop assembly comprising:

a) a cap for a measuring cylinder, the cap receiving an elongated longitudinally movable stop member;

b) a gauge rod extending along and detachably affixed to the stop member, the gauge rod having a number of notches spaced apart along a first edge thereof; and, c) a blade on the cap, the blade selectively engageable in a selected one of the notches wherein, when the blade is engaged in the selected one of the notches, the stop member is longitudinally fixed relative to the cap.

* * * * *